US011587780B2

(12) United States Patent
Tateishi et al.

(10) Patent No.: US 11,587,780 B2
(45) Date of Patent: Feb. 21, 2023

(54) TIME-OF-FLIGHT MASS SPECTROMETER

(71) Applicant: SHIMADZU CORPORATION, Kyoto (JP)

(72) Inventors: Yusuke Tateishi, Kyoto (JP); Hiroyuki Miura, Kyoto (JP); Hideaki Izumi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 20 days.

(21) Appl. No.: 17/466,565

(22) Filed: Sep. 3, 2021

(65) Prior Publication Data

US 2022/0189758 A1 Jun. 16, 2022

(30) Foreign Application Priority Data

Dec. 15, 2020 (JP) ..... JP2020-207464
Jul. 28, 2021 (JP) ..... JP2021-122956

(51) Int. Cl.
*H01J 49/40* (2006.01)
*H01J 49/06* (2006.01)

(52) U.S. Cl.
CPC ..... *H01J 49/408* (2013.01); *H01J 49/061* (2013.01); *H01J 49/405* (2013.01); *H01J 49/406* (2013.01)

(58) Field of Classification Search
CPC ..... H01J 49/06; H01J 49/061; H01J 49/40; H01J 49/401; H01J 49/403; H01J 49/405; H01J 49/406; H01J 49/408
See application file for complete search history.

(56) References Cited

U.S. PATENT DOCUMENTS 10,950,425 B2 * 3/2021 Verenchikov ..... H01J 49/408
2020/0243322 A1 * 7/2020 Stewart ..... H01J 49/061

FOREIGN PATENT DOCUMENTS

| | | | | |
|---|---|---|---|---|
| JP | 2013-517595 | A | 5/2013 | |
| JP | 2014-531119 | A | 11/2014 | |
| JP | 5915760 | B2 | 5/2016 | |
| JP | 2018-517244 | A | 6/2018 | |
| WO | 2011/086430 | A1 | 7/2011 | |
| WO | 2013/057505 | A2 | 4/2013 | |
| WO | WO-2013057505 | A2 * | 4/2013 | ..... H01J 49/062 |
| WO | 2016/174462 | A1 | 11/2016 | |

* cited by examiner

*Primary Examiner* — David E Smith
(74) *Attorney, Agent, or Firm* — Sughrue Mion, PLLC

(57) ABSTRACT

Provided is a time-of-flight mass spectrometer including: a loop-orbit defining electrode (21) including an outer electrode (211) and inner electrode (212) located on the outside and inside of a loop orbit, respectively; an ion inlet (22); an ion outlet (23) provided in either the outer or inner electrode; a loop-flight voltage applier (28) configured to apply loop-flight voltages to the outer and inner electrodes, respectively; a set of deflecting electrodes (24) facing each other across a section of an n-th loop orbit, where n is a predetermined number, the deflecting electrodes including a first portion (241) which faces the n-th loop orbit and a second portion (242) which includes other portions; and a voltage applier (29) configured to apply deflecting voltages to the first portion so as to reverse the drifting direction of the ions flying in the n-th loop orbit, and a voltage to the second portion so as to create the loop-flight electric field.

6 Claims, 10 Drawing Sheets

TIME-OF-FLIGHT MASS SPECTROMETER

TECHNICAL FIELD

The present invention relates to a time-of-flight mass spectrometer.

BACKGROUND ART

There is a type of mass spectrometer known as a time-of-flight mass spectrometer (TOF-MS). In a TOF-MS, a predetermined amount of acceleration energy is imparted to a cluster of ions generated from a sample, to simultaneously introduce the ions into a flight space. After flying a path of a predetermined length defined within the flight space, the ions are sequentially detected by an ion detector, and the intensity of the ions at each point in time is recorded. The period of time required for the ions which have been given equal amounts of energy to fly the predetermined length of path (time of flight) varies depending on their respective mass-to-charge ratios. For a TOF-MS, the relationship between the mass-to-charge ratio and time of flight of an ion is previously tested. Based on that relationship, the time of flight of the cluster of ions are converted to respective mass-to-charge ratios to obtain a mass spectrum.

In a TOF-MS, the longer the flight path of the ions is, the more the ions are separated according to their mass-to-charge ratios, and the higher the mass-resolving power becomes. However, in the case of a mass spectrometer in which ions are made to fly a simple linear path, elongating the flight path directly increases the size of the device. In order to elongate the flight path for the ions without increasing the size of the device, a reflectron mass spectrometer and a multi-turn loop mass spectrometer have been proposed. In the reflectron mass spectrometer, the flight distance of the ions is increased by reversing the flight direction of the ions by a reflectron electrode so as to make the ions fly a reciprocating path within the flight space. In the loop mass spectrometer, the flight distance of the ions is increased by making ions repeatedly fly a loop orbit (closed orbit).

In the reflectron mass spectrometer, the flight distance can be almost doubled as compared to the case where ions are made to fly a simple oneway. However, a flight distance longer than that cannot be obtained. In the loop mass spectrometer, since ions are made to fly a loop orbit repeatedly, an "overtaking problem" occurs, in which an ion having a smaller mass-to-charge ratio and flying at a higher speed overtakes an ion having a larger mass-to-charge ratio and flying at a lower speed. This makes it impossible to distinguish the two ions of different travel distances.

Accordingly, in recent years, a multi-turn time-of-flight mass spectrometer (MT-TOF-MS) with an open orbit (quasi-closed orbit) and a multi-reflection time-of-flight mass spectrometer (MR-TOF-MS) have been proposed (for example, see Patent Literatures 1-3).

In the MT-TOF-MS, an orbit having a specific shape, such as a circular, elliptical or figure-"8" shape, is defined within the flight space. Ions are made to repeatedly fly this path while gradually changing their position in a predetermined direction (drift) for each turn. In the MR-TOF-MS, two reflectron electrodes are placed opposite to each other across the flight space. Ions are made to repeatedly fly back and forth between the two reflectron electrodes while gradually changing their position (drift) in a predetermined direction for each two-way path. These configurations make it possible to elongate the flight distance of the ions and improve the mass-resolving power without increasing the size of the mass spectrometer.

For example, an MT-TOF-MS described in Patent Literature 1 includes a loop-orbit-defining electrode formed by outer electrode and inner electrode. The outer electrode has a substantially spheroidal shape formed by a plurality of segment electrodes combined together. The inner electrode, which is located inside the outer electrode, also has a substantially spheroidal shape formed by a plurality of segment electrodes combined together which are arranged so as to respectively face the segment electrodes forming the outer electrode. The loop orbit of the ions is defined between the outer and inner electrodes. In this MT-TOF-MS, an electrostatic field for making ions repeatedly fly in the loop orbit ("loop-flight electric field") is created within the spheroidal space between the outer and inner electrodes ("flight space") by applying predetermined voltages to the segment electrodes forming the outer electrode as well as those forming the inner electrode, respectively. The outer electrode has an ion inlet for introducing ions into the loop orbit of the ions and an ion outlet for releasing ions from the loop orbit of the ions. Ions which have been introduced from the ion inlet into the flight space are made to fly a loop path in the flight space, and the loop path revolves around the axis of the substantially spheroidal space by a predetermined angle (drift angle) for each turn of the ions. After completing a previously specified number of turns (e.g., 20-30 turns), the ions are released from the ion outlet to the outside of the loop-flight space and detected by an ion detector.

Patent Literature 1 also proposes a configuration in which a set of deflecting electrodes face each other across a section of an n-th loop orbit of the ions (where n is a predetermined number), and predetermined voltages (deflecting voltages) are applied to those electrodes to create a deflecting electric field. In this MT-TOF-MS, ions are initially made to turn a predetermined number of times. Subsequently, the drifting direction of the ions is reversed by the deflecting electric field, and the ions are once more made to turn a predetermined number of times, to be ultimately released to the outside of the flight space. By this configuration, the mass-resolving power can be even further improved by making the ions turn a greater number of times and fly a longer distance than in the case where the deflecting electric field is not used.

CITATION LIST

Patent Literature

Patent Literature 1: JP 2014-531119 A
Patent Literature 2: JP 2013-517595 A
Patent Literature 3: JP 2018-517244 A

SUMMARY OF INVENTION

Technical Problem

However, it has been revealed that the deflecting electric field created by applying the deflecting voltages to the deflecting electrodes arranged in the previously described manner actually deflects not only ions flying in the n-th loop orbit but also ions flying in the neighboring loop orbit, so that it is impossible to make ions fly in the predetermined loop orbit.

Although the descriptions so far have been concerned with the MT-TOF-MS configured to gradually revolve the flight path of the ions by a predetermined angle for each turn of the ions, a similar problem also occurs in an MT-TOF-MS configured to gradually translate the flight path of the ions in a predetermined direction by a constant amount for each turn of the ions (for example, see Patent Literature 1) or in an MR-TOF-MS.

The problem to be solved by the present invention is to provide a technique to be applied to a multi-turn or multi-reflection time-of-flight mass spectrometer, for reversing the drifting direction of the ions flying in an n-th loop orbit (where n is a predetermined number), or in an m-th reciprocating path (where m is a predetermined number), while suppressing unwanted deflection of the ions flying in a loop orbit other than the n-th loop orbit, or in a reciprocating path other than the m-th reciprocating path.

Solution to Problem

The first mode of the time-of-flight mass spectrometer according to the present invention developed for solving the previously described problem includes:

a loop-orbit defining electrode configured to create a loop-flight electric field for defining a loop orbit in which ions are made to repeatedly turn while gradually drifting in a predetermined direction for each turn, the loop-orbit defining electrode including an outer electrode located on the outside of the loop orbit and an inner electrode located on the inside of the loop orbit;

an ion inlet for introducing ions into the loop orbit;

an ion outlet for releasing ions from the loop orbit;

a loop-flight voltage applier configured to apply loop-flight voltages to the outer electrode and the inner electrode, respectively, so as to create the loop-flight electric field;

a set of deflecting electrodes facing each other across a section of an n-th loop orbit, where n is a predetermined number, the deflecting electrodes including a first portion which faces the n-th loop orbit and a second portion which includes other portions; and a voltage applier configured to apply a deflecting voltage to the first portion so as to reverse the drifting direction of the ions flying in the n-th loop orbit, and a voltage to the second portion so as to create the loop-flight electric field.

The second mode of the time-of-flight mass spectrometer according to the present invention developed for solving the previously described problem includes:

a reciprocating-path defining electrode configured to create a reciprocating electric field for defining a reciprocating path in which ions are made to repeat a reciprocating motion while drifting in a predetermined direction for each reciprocating trip, the reciprocating-path defining electrode including a set of reflectron electrodes located on both sides of a flight space of the ions;

an ion inlet for introducing ions into the round-trip path;

an outlet inlet, for releasing ions from the reciprocating path;

a reciprocating voltage applier configured to apply reciprocating voltages to the set of reflectron electrodes, respectively, so as to create the reciprocating electric field;

a set of deflecting electrodes facing each other across a section of an m-th reciprocating path, where m is a predetermined number, the deflecting electrodes including a first portion which faces the m-th reciprocating path and a second portion which includes other portions; and a voltage applier configured to apply a deflecting voltage to the first portion so as to reverse the drifting the drifting direction of the ions flying in the m-th reciprocating path and a voltage to the second portion so as to create the reciprocating electric field.

Advantageous Effects of Invention

The first mode of the present invention is a multi-turn time-of-flight mass spectrometer (MT-TOF-MS) with an open orbit (quasi-closed orbit). In this mass spectrometer, a loop-flight electric field for defining a loop orbit in which ions are made to fly is created by applying predetermined loop-flight voltages to the outer and inner electrodes forming the loop-orbit defining electrode. Ions are introduced into this loop orbit through the ion inlet and fly in the loop orbit while drifting in the predetermined direction for each turn. At the n-th loop orbit (where n is a predetermined number), a set of deflecting electrodes are arranged so as to face each other across the loop orbit. The deflecting electrodes include a first portion which faces the n-th loop orbit and a second portion which includes other portions. Deflecting voltages are applied to the first portion to reverse the drifting direction of the ions flying in the n-th loop orbit. In this operation, the deflecting voltages are applied to only the first portion facing the n-th loop orbit; a voltage for creating the loop-flight electric field is applied to the second portion. In the case of a conventional MT-TOF-MS, the deflecting voltages are applied to the entire area of the deflecting electrodes, so that the deflecting electric field is created over a wide area around the deflecting electrodes, causing deflection of the ions flying in the loop orbit neighboring the n-th loop orbit. By comparison, in the first mode of the present invention, a voltage for creating the loop-flight electric field is applied to the second portion other than the portion which faces the n-th loop orbit. Thus, the loop-flight electric field defining the loop orbit neighboring the n-th loop orbit is prevented from being disturbed and causing unwanted deflection of the ions.

The second mode of the present invention is a multi-reflection time-of-flight mass spectrometer (MR-TOF-MS). In this mass spectrometer, a reciprocating electric field for defining a reciprocating path in which ions are made to fly is created by applying predetermined reciprocating voltages to a set of reflectron electrodes located on both sides of the flight space of the ions. Ions are introduced into the reciprocating path through the ion inlet and fly in the reciprocating path while drifting in the predetermined direction for each reciprocating trip. At the m-th reciprocating path (where m is a predetermined number), a set of deflecting electrodes are arranged so as to face each other across the reciprocating path. The deflecting electrodes include a first portion which faces the m-th reciprocating path and a second portion which includes other portions. Deflecting voltages are applied to the first portion to reverse the drifting direction of the ions flying in the m-th reciprocating path. In this operation, the deflecting voltages are applied to only the first portion facing the m-th reciprocating path; a voltage for creating the reciprocating electric field is applied to the second portion. In the second mode of the present invention, since the reciprocating electric field is created at the second portion other than the portion which faces the m-th reciprocating path, the reciprocating electric field defining the reciprocating path neighboring the m-th reciprocating path is prevented from being disturbed and causing unwanted deflection of the ions.

DESCRIPTION OF EMBODIMENTS

Figure 1:
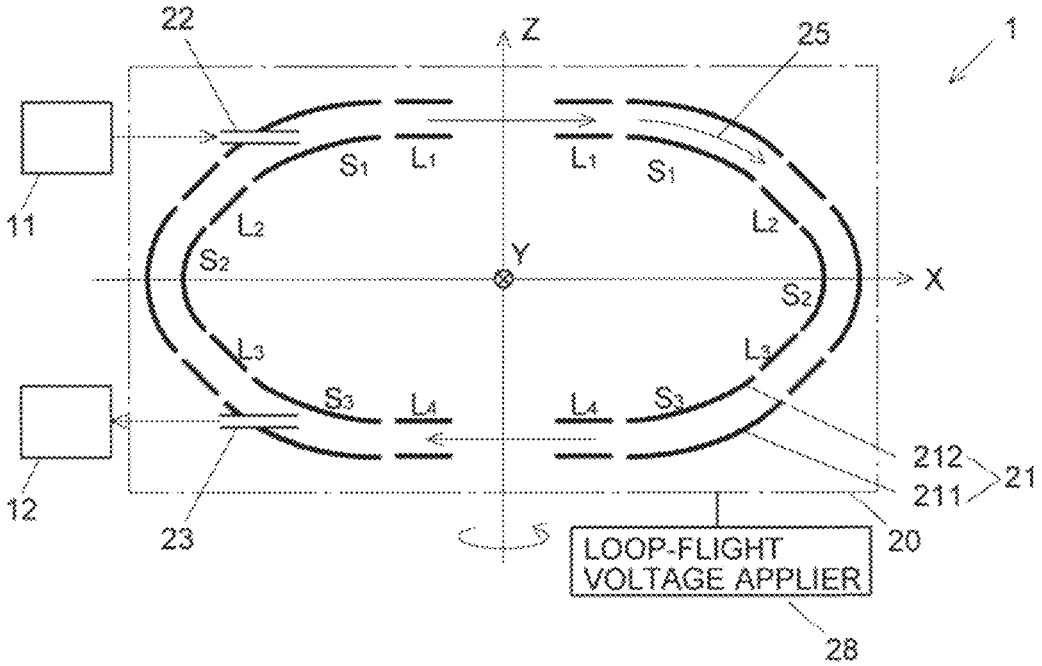
FIG. 1 is a configuration diagram of the main components of a multi-turn time-of-flight mass spectrometer (MT-TOF- MS) as one embodiment of the time-of-flight mass spectrometer according to the present invention.

A multi-turn time-of-flight mass spectrometer (MT-TOF-MS) with an open orbit (quasi-closed orbit) and a multi-reflection time-of-flight mass spectrometer (MR-TOF-MS), both of which are embodiments of the time-of-flight mass spectrometer according to the present invention, are hereinafter individually described with reference to the attached drawings.

(1) Embodiment of MT-TOF-MS

FIGS. 1-4 show the configuration of the main components of the MT-TOF-MS 1 according to the present embodiment. The MT-TOF-MS 1 according to the present embodiment includes an ion source 11, ion flight unit 20, and ion detector 12.

As the ion source 11, for example, a device including an ionizer configured to ionize a sample and an ion trap configured to temporarily hold ions is used. A cluster of ions having various mass-to-charge ratios are produced from a sample by the ionizer and temporarily captured within the ion trap. After the ions have been cooled with a cooling gas, a predetermined amount of energy is imparted to the ions, whereby the ions in the form of a packet are simultaneously ejected into the ion flight unit 20.

The ion flight unit 20 includes a main electrode 21, ion inlet 22, ion outlet 23, and deflecting electrodes 24. Additionally, this unit is provided with a loop-flight voltage applier 28 configured to apply predetermined voltages to the main electrode 21 and a deflecting voltage applier 29 configured to apply predetermined voltages to the deflecting electrodes 24.

Figure 2:
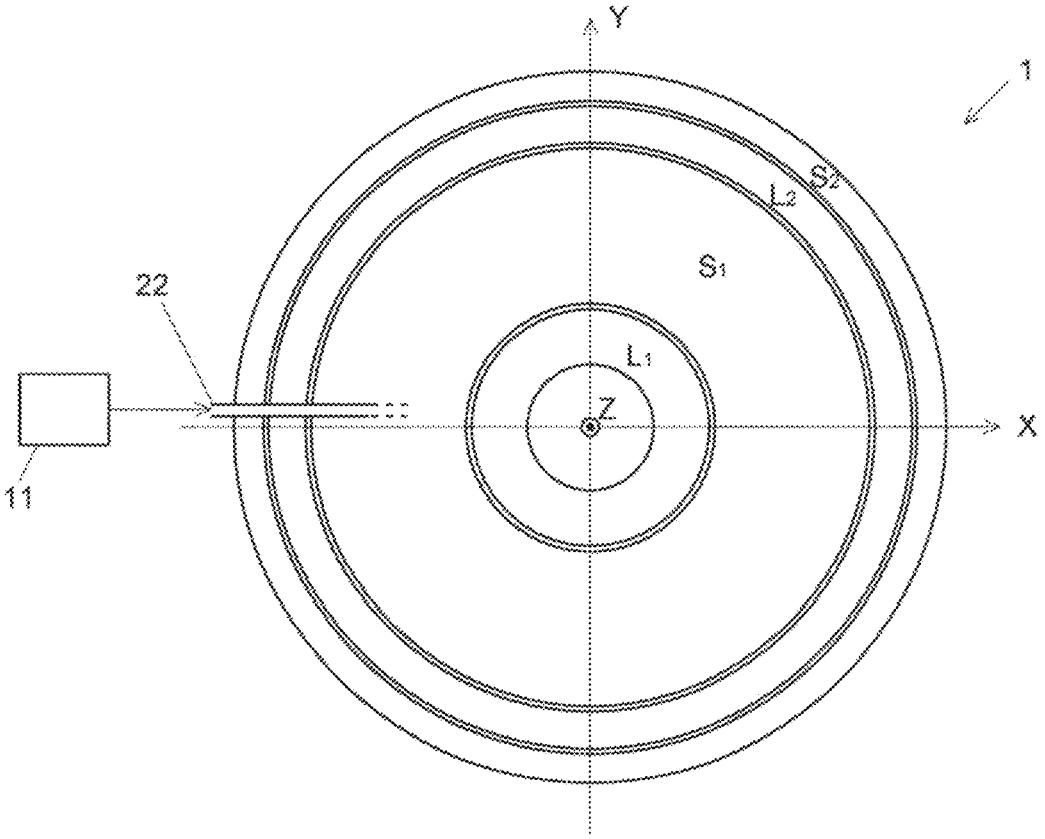
FIG. 2 is a top view of the MT-TOF-MS according to the present embodiment.

The main electrode 21 includes a substantially spheroidal outer electrode 211 and a substantially spheroidal inner electrode 212 which is located inside the outer electrode 211. FIG. 1 is a vertical sectional view of the electrodes at the ZX plane, which is a plane containing both the Z-axis that is the axis of rotation of the substantially spheroidal shape of the outer and inner electrodes 211 and 212, and the X-axis that is an axis perpendicular to the Z-axis. Cutting the main electrode 21 at a plane which contains the Z-axis always reveals a section having substantially the same shape as shown in FIG. 1, regardless of the angle of orientation of the section (i.e., the angular position around the Z-axis). FIG. 2 is a top view of the main electrode 21 from the positive side of the Z-axis. An axis perpendicular to both the Z-axis and X-axis is defined as the Y-axis. A plane containing both the X-axis and Y-axis is the XY plane.

The outer and inner electrodes 211 and 212 are formed by three partial-electrode pairs S1, S2 and S3 each of which consists of a pair of electrodes having a curved shape in the ZX-plane and facing each other, combined with four partial-electrode pairs L1, L2, L3 and L4 each of which consists of a pair of electrodes having a linear shape in the ZX-plane and facing each other. The partial-electrode pair S2 as viewed on the ZX-plane is located at both ends of the main electrode 21 in the X-direction and has a symmetrical shape with respect to the X-axis. The partial-electrode pair S1 is located on the positive side of the Z-direction as viewed from the partial-electrode pair S2. The partial-electrode pair S3 is located on the negative side of the Z-direction as viewed from the partial-electrode pair S2 and is symmetrical to the partial-electrode pair S1 with respect to the X-axis. The partial-electrode pair L2 is located between the partial-electrode pairs S1 and S2. The partial-electrode pair L3 is located between the partial-electrode pairs S2 and S3, having a symmetrical shape to the partial-electrode pair L2 with respect to the X-axis. The partial-electrode pair L1 is shaped like a doughnut plate perpendicular to the Z-axis and is located on the positive side of the Z-direction as well as inside the partial-electrode pair S1 when projected onto the XY-plane. The partial-electrode pair L4 is also shaped like a doughnut plate perpendicular to the Z-axis and is located on the negative side of the Z-direction, having a symmetrical shape to the partial-electrode pair L1 with respect to the XY-axis.

The combination of those partial-electrode pairs gives each of the outer and inner electrodes 211 and 212 a substantially spheroidal shape in their entirety. For example, the outer electrode 211 has an external shape measuring 500 mm in the major-axis direction (X or Y direction) and 300 mm in the minor-axis direction (Z-direction). Additionally, for example, the distance between the outer and inner electrodes 211 and 212 is 20 mm. Reducing the entire size of the outer and inner electrodes 211 and 212 allows for the downsizing of the entire MT-TOF-MS 1.

The partial-electrode pairs S1, S2 and S3 which are curved in the ZX-plane are given potentials from the loop-flight voltage applier 28 so that an electric field directed from the outer electrode 211 to the inner electrode 212 is created. On the other hand, in the partial-electrode pairs L1, L2, L3 and L4 which are linear in the ZX-plane, the same potential is given to both the outer and inner electrodes 211 and 212 from the loop-flight voltage applier 28. Thus, a loop-flight electric field which makes ions fly in a loop orbit is created within the space between the outer and inner electrodes 211 and 212. This electric field defines a loop orbit 25 for ions within the inner space.

Figure 3:
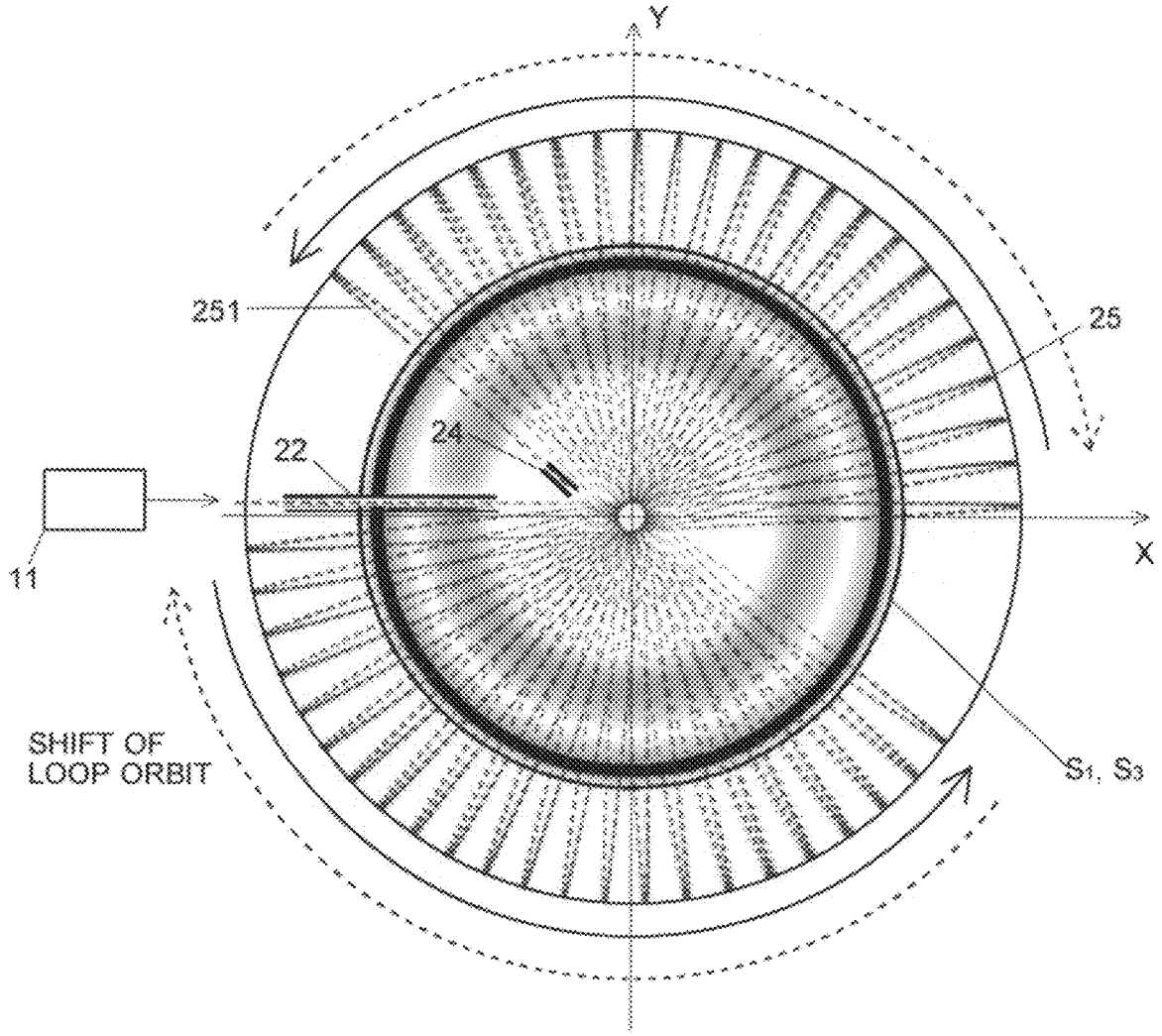
FIG. 3 is a diagram illustrating the loop orbit in the MT-TOF-MS according to the present embodiment.

The partial-electrode pair S1 in the outer electrode 211 is provided with an ion inlet 22 for introducing ions ejected from the ion source 11 into the loop orbit 25. The ion inlet 22 is located at a position slightly displaced from the X axis toward the positive side of the Y-direction, and is arranged so that the ions from the ion source 11 are injected substantially parallel to the X-axis. The ions undergo a centripetal force from the loop-flight electric field created by the partial-electrode pair S1 at a position immediately after the point of injection from the ion inlet 22 into the loop orbit 25. Additionally, due to the displacement of the ion inlet 22 from the X-axis toward the positive side of the Y-direction, the ions also undergo a force directed toward the X-direction. Consequently, the ions fly along the substantially elliptical loop orbit 25 while drifting in such a manner that the loop orbit gradually changes its orientation counter-clockwise as viewed from the positive side of the Y-direction for each turn of the ions (see FIG. 3). In FIG. 3, the loop orbit 25 of the ions is shown by a projection onto the XY-plane.

Figure 4:
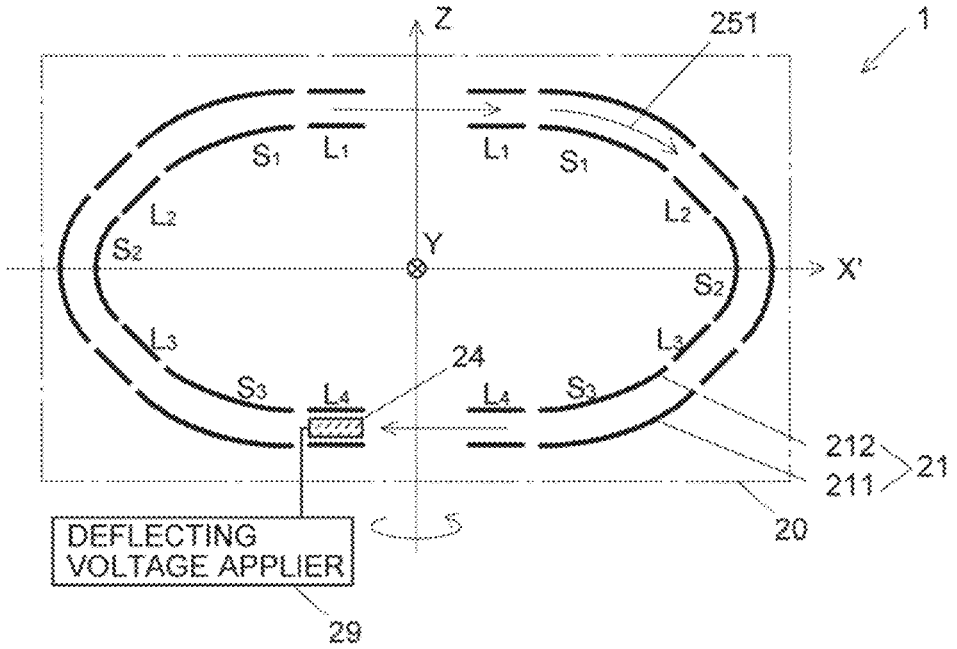
FIG. 4 is a diagram illustrating the location of the deflecting electrodes in the MT-TOF-MS according to the present embodiment.

The deflecting electrodes 24 are located at the n-th loop orbit 251 (where n is a predetermined number). The deflecting electrodes 24 are a pair of plate electrodes arranged at a slightly displaced position from the Z-axis within the inner space of the partial-electrode pair L4. The reason for the displacement from the Z-axis is to prevent the deflecting electrodes 24 from interfering with loop orbits 25 other than the n-th loop orbit 251. FIG. 4 is a cross-sectional view at a ZX'-plane containing the n-th loop orbit 251. The deflecting electrodes 24 are arranged so as to face each other across the loop orbit 251, with their front surfaces parallel to the ZX'-plane. Detailed configurations of the deflecting electrodes 24 will be described later. Predetermined deflecting voltages are applied to the deflecting electrodes 24 to create a deflecting electric field which acts on the ions and reverses the drifting direction of the ions.

After the drifting direction has been reversed in the n-th loop orbit 251, the ions fly in the loop orbit 25 while drifting in the opposite direction (indicated by the dashed arrows in FIG. 3) to the previous drifting direction (indicated by the solid arrows in FIG. 3) for each turn. In the top view shown in FIG. 3, the ions appear to follow their previous flight path in the opposite direction. However, the flight direction of the ions as viewed in FIG. 1 remains unchanged (clockwise). This means that both the ions travelling toward the deflecting electrodes 24 and the ions deflected by the deflecting electric field created by the deflecting electrodes 24 fly in the same direction, and therefore, will not collide with one another.

The ion outlet 23 is provided in the partial-electrode pair S3. The ions which have turned a predetermined number of times in the loop orbit 25, have reversed their drifting direction by being deflected in the deflecting electric field, and have once more turned a predetermined number of times in the loop orbit 25, are released from the ion outlet 23 to the outside and enter the ion detector 12.

In the system of the ion source 11, main electrode 21 and ion detector 12 described thus far, the large number of ions having various mass-to-charge ratios ejected from the ion source 11 take different periods of time (times of flight) depending on their respective mass-to-charge ratios to complete their flight in the loop orbit 25 defined within the inner space of the main electrode 21. Consequently, the ions are separated from each other according to their mass-to-charge ratios and ultimately detected by the ion detector 12.

Figure 5:
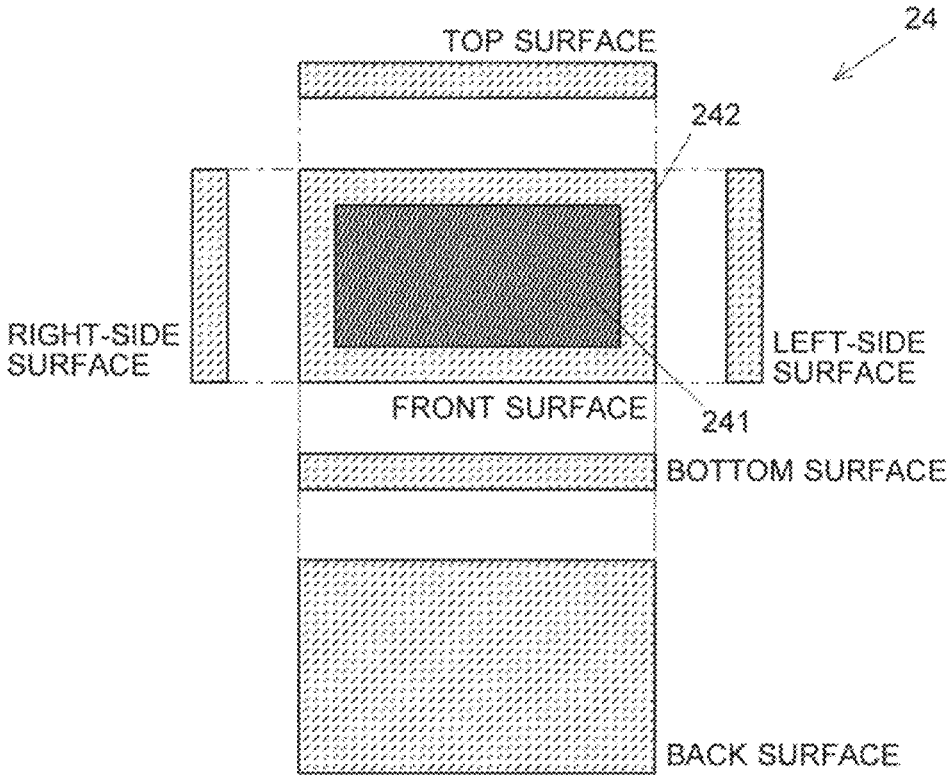
FIG. 5 is a diagram illustrating the portion of the deflecting electrode to which a deflecting voltage is to be applied and the portion to which a loop-flight voltage is to be applied in the MT-TOF-MS according to the present embodiment.

The MT-TOF-MS according to the present embodiment is characterized by the configuration of the deflecting electrodes 24. As shown in FIG. 5, each deflecting electrode 24 is configured to allow two different voltages to be respectively applied to a first area 241 (a first portion) which is a central portion of the front surface (facing surface) of the electrode and a second area 242 (a second portion) which includes the remaining portions (including the periphery of the front surface, the side surface, and the back surface). An electrode configured in this manner can be created, for example, by using a printed circuit board (PCB) including a ceramic substrate on which a plurality of electrodes are arranged with a gap in between (or with an insulator sandwiched in between).

The voltage applied to the first area 241 is a voltage for reversing the drifting direction of the ions in the loop orbit 25 (i.e., the deflecting voltage). Specifically, a predetermined voltage having an opposite polarity to the ions is applied to the first area 241 of one of the deflecting electrodes 24 located closer to the (n−1)th loop orbit 25, while a predetermined voltage having the same polarity as the ions is applied to the first area 241 of the other deflecting electrode 24 (or this area is grounded). The ions flying in the n-th loop orbit 251 are thereby deflected toward the (n−1)th loop orbit 25, and their drifting direction is reversed. The voltage applied to the second area 242 is a voltage for creating an electric field identical to the loop-flight electric field, i.e., the same voltage as applied to the electrode L4.

In the present embodiment, the deflecting electrodes 24 are arranged so as to face each other within the electrode L4, i.e., across a section of the loop orbit 25 in which ions are made to fly linearly. Arranging the deflecting electrodes 24 within this type of section where there is no potential gradient and ions are made to fly linearly simplifies the structure of the deflecting electrodes 24 since only a single voltage needs to be applied to the portions other than the first area 241.

Figure 6:
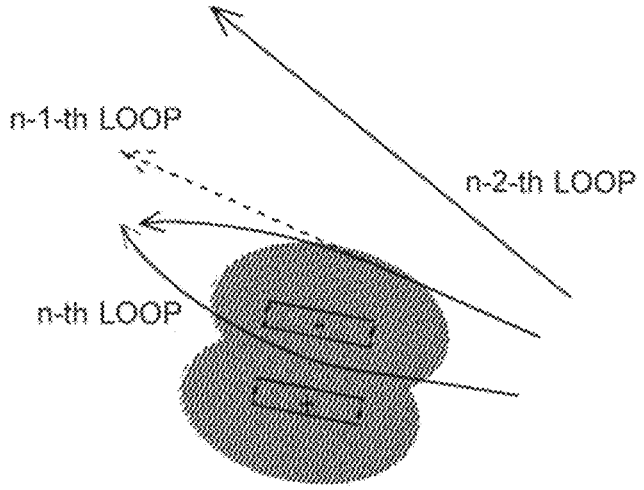
FIG. 6 is a diagram illustrating the deflecting electric field in a conventional MT-TOF-MS.

In the case of a conventional MT-TOF-MS configured to reverse the drifting direction, the deflecting voltages are applied to the entire area of the deflecting electrodes. For example, as shown in FIG. 6, when the measurement target is a positive ion, a negative voltage is applied to the entire area of the electrode located closer to the (n−1)th loop orbit, while a positive voltage is applied to the entire area of the other electrode. Therefore, the fringe electric field created by the application of the deflecting voltages deflects not only the ions flying in the n-th loop orbit but also those flying in the neighboring (n−1)th loop orbit. Therefore, it is impossible to make the ions fly in the predetermined loop orbit.

Figure 7:
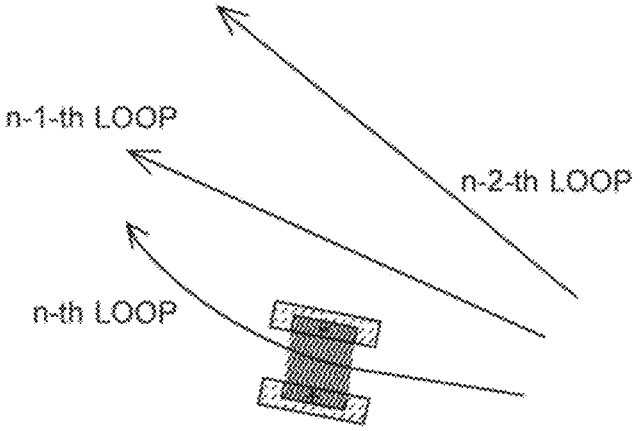
FIG. 7 is a diagram illustrating the deflecting electric field in the MT-TOF-MS according to the present embodiment.

By comparison, in the case of the MT-TOF-MS according to the present embodiment, as shown in FIG. 7, the deflecting voltage is only applied to the first area 241 at the central portion of the front surface of the deflecting electrodes 24; the loop-flight voltage is applied to the second area 242 including the other portions. Therefore, the deflecting electric field is only created at the n-th loop orbit 251. Thus, the loop-flight electric field defining the (n−1)th loop orbit 25 neighboring the n-th loop orbit is prevented from being disturbed and causing unwanted deflection of the ions.

(2) Modified Example of MT-TOF-MS

Figure 8:
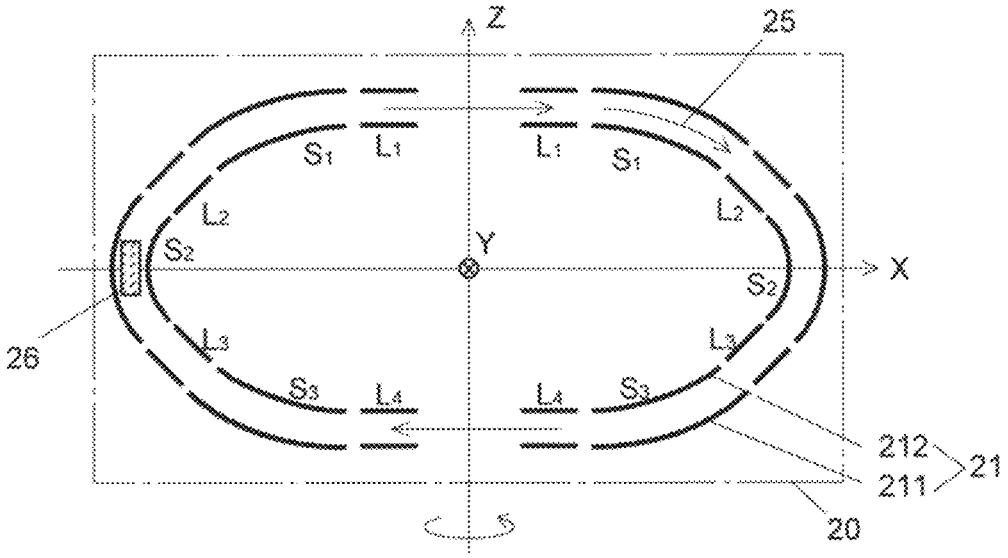
FIG. 8 is a diagram illustrating the deflecting electric field in an MT-TOF-MS according to a modified example.
Figure 9:
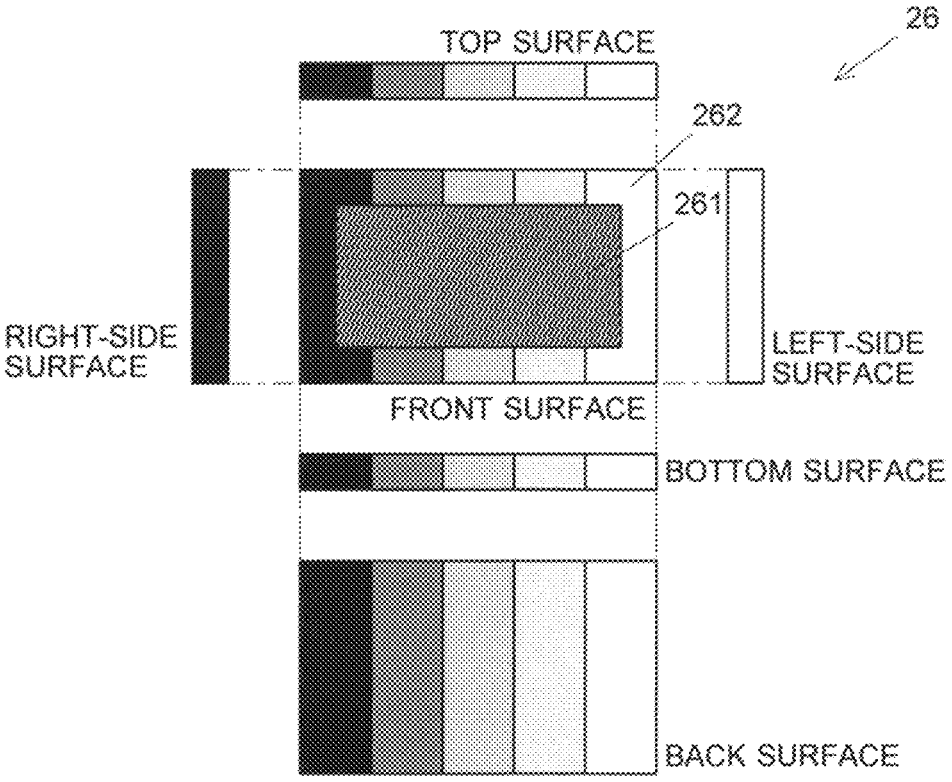
FIG. 9 is a diagram illustrating the portion of the deflecting electrode to which a deflecting voltage is to be applied and the portion to which a loop-flight voltage is to be applied in the MT-TOF-MS according to the modified example.

The previous embodiment is one configuration example and can be appropriately changed or modified. The deflecting electrodes 24 in the previous embodiment are located at the position of electrode L4. It is possible to place deflecting electrodes at a different location. For example, as shown in FIG. 8, deflecting electrodes 26 may be located at the position of electrode S2. It should be noted that an electric field which pulls ions in the direction from the outer electrode to the inner electrode is formed at this location as the loop-flight electric field. Therefore, as shown in FIG. 9, while the first area 261 of the electrodes is supplied with the deflecting voltages in the same manner as in the previous embodiment, the second area 262 is supplied with a system of voltages which create an electric field that corresponds to the loop-flight electric field. In this configuration, different voltages may be respectively applied to a plurality of electrodes provided in the second area 262.

Figure 10:
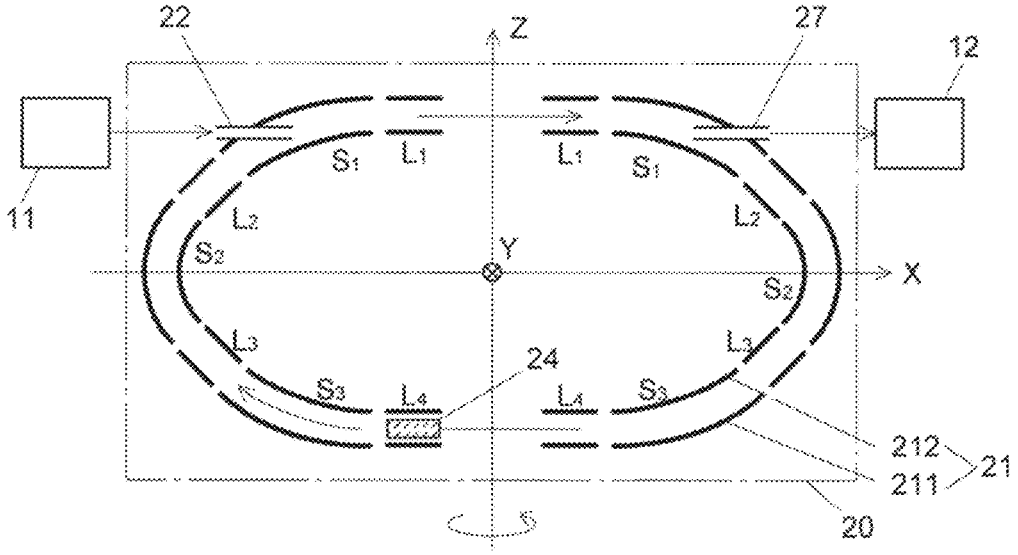
FIG. 10 is a diagram illustrating the configuration of an MT-TOF-MS according to another modified example.

In the previous embodiment, the ion inlet 22 and the ion outlet 23 are located on the same side as viewed from above. This can be modified as shown in FIG. 10, in which these two elements are located on the opposite sides with respect to the Z-axis, with the ion inlet 22 located on the negative side of the X-axis (as in the previous embodiment) and the ion outlet 27 on the positive side of the X-axis. In this case, both the ion inlet 22 and the ion outlet 27 are provided in electrode S1.

The previous embodiment is concerned with an MT-TOF-MS configured to gradually revolve the flight orbit of the ions by a predetermined angle for each turn of the ions. Deflecting electrodes similar to those used in the previous embodiment can also be used in an MT-TOF-MS configured to gradually translate the flight orbit of the ions in a predetermined direction by a constant amount for each turn of the ions (for example, see Patent Literature 1).

(3) Embodiment of MR-TOF-MS

Figure 11:
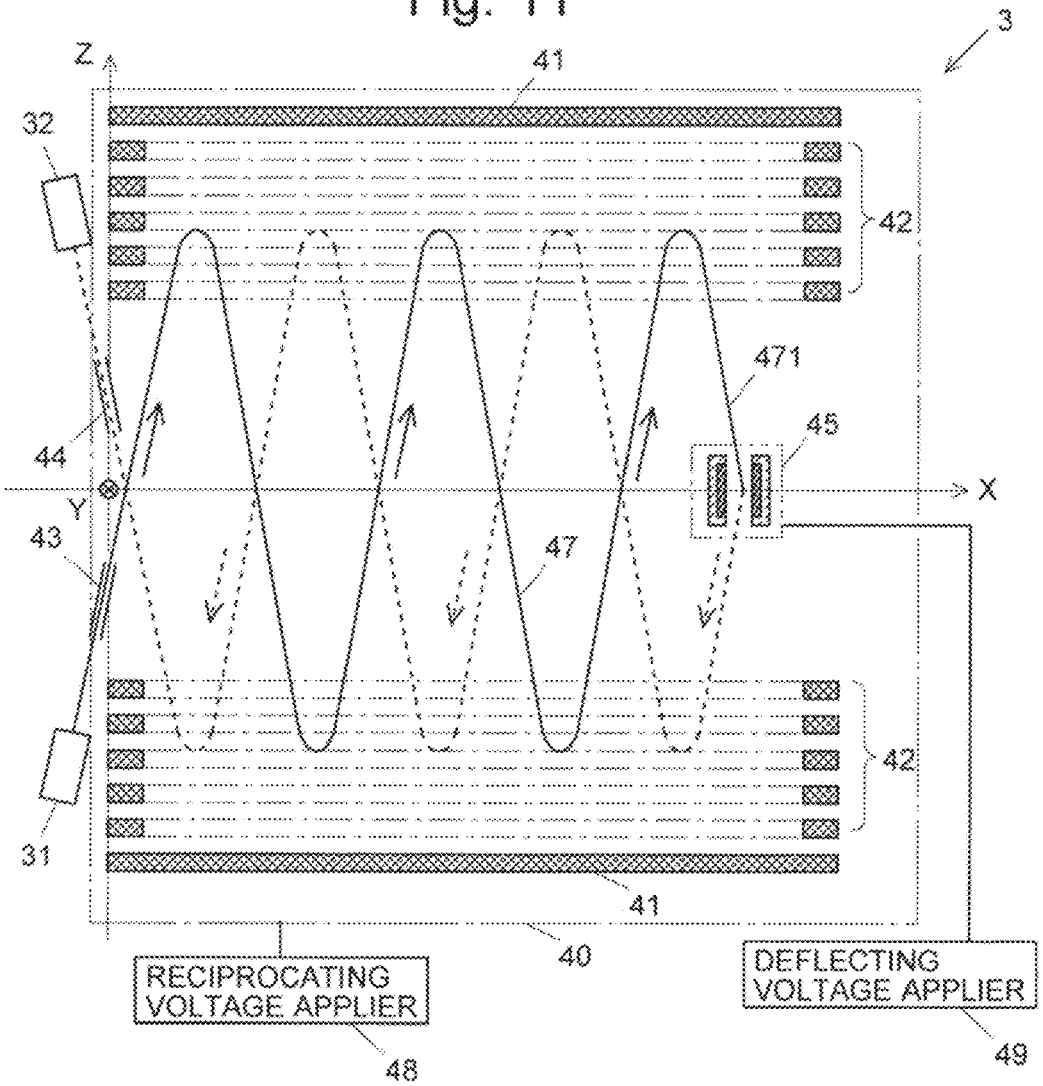
FIG. 11 is a configuration diagram of the main components of a multi-reflection time-of-flight mass spectrometer (MR-TOF-MS) as one embodiment of the time-of-flight mass spectrometer according to the present invention.

FIG. 11 is a schematic diagram showing an MR-TOF-MS 3 according to the present embodiment. The MR-TOF-MS 3 according to the present embodiment includes an ion source 31, ion flight unit 40, and ion detector 32. It should be noted that FIG. 11 shows fewer reciprocations than the actual number so as to provide an easy-to-understand view of the reciprocating path of the ions.

As the ion source 31, for example, a device including an ionizer configured to ionize a sample and an ion trap configured to temporarily hold ions is used. A cluster of ions having various mass-to-charge ratios are produced from a sample by the ionizer and temporarily captured within the ion trap. After the ions have been cooled with a cooling gas, a predetermined amount of energy is imparted to the ions, whereby the ions in the form of a packet are simultaneously ejected into the ion flight unit 40.

The ion flight unit 40 includes back plate electrodes 41, reflectron electrodes 42, ion inlet 43, ion outlet 44, and deflecting electrodes 45. Additionally, this unit is provided with a reciprocating voltage applier 48 configured to apply predetermined voltages to the back plate electrodes 21 and the reflectron electrodes 42, as well as a deflecting voltage applier 49 configured to apply predetermined voltages to the deflecting electrodes 45.

As shown in FIG. 11, the back plate electrodes 41 are a pair of plate electrodes arranged on the positive and negative sides of the Z-direction, with the flight space of the ions in between. The reflectron electrode 42 is formed by five frame-shaped electrodes and located at each of the two back plate electrodes 41 on the side facing the flight space. The configuration shown in FIG. 11 is a mere example. The number of frame-shaped electrodes forming the reflectron electrode 42 may be less than or greater than five.

The deflecting electrodes 45 are located at the farther end of the flight space in the X-direction as viewed from the side on which ions enter or leave the flight space (i.e., the side on which the ion source 31 and the ion detector 32 are located). Predetermined voltages having the same polarity as the target ions are respectively applied to the back plate electrodes 41 and the reflectron electrodes 42, whereby a reciprocating electric field in which the potential increases toward the back plate electrode 41 is formed.

Ions are introduced from the ion source 31 into the flight space in a direction slightly inclined from the Z-axis in the X-axis direction. The ions introduced from the ion source 31 into the flight space initially fly toward the back plate electrode 41 located on the positive side of the Z-direction. Since the reciprocating electric field whose potential increases toward the back plate electrode 41 is created within the space surrounded by the back plate electrode 41 and the reflectron electrode 42 as described earlier, the ions which have entered this space are gradually decelerated. The flight direction of the ions is soon reversed to the negative side of the Z-direction, and the ions begin to fly toward the other back plate electrode 41 located on the negative side of the Z-direction. In this manner, the ions introduced into the flight space fly in a reciprocating path 47 in which the flight path is reversed every time the ions enter the space surrounded by the back plate electrode 41 and the reflectron electrode 42. In this reciprocating path, the ions gradually drift toward the positive side of the X-direction for each reciprocation.

The deflecting electrodes 45 are located at the position corresponding to the m-th reciprocating path 471 on the X-axis (where m is a predetermined number). The deflecting electrodes 45 are a pair of plate electrodes, which are arranged so as to face each other across the m-th reciprocating path, with their front surfaces parallel to the YZ-plane. Detailed configurations of the deflecting electrodes 45 will be described later. Predetermined deflecting voltages are applied to the deflecting electrodes 45, whereby a deflecting electric field is created which acts on the ions and reverses the drifting direction of the ions from the positive side to the negative side of the X-direction.

After the drifting direction has been reversed in the m-th reciprocating path 471, the ions fly in the reciprocating path 47 while drifting in the opposite direction (indicated by the dashed arrows in FIG. 11) to the previous drifting direction (indicated by the solid arrows in FIG. 11) for each reciprocation, to ultimately exit from the end of the flight space and enter the ion detector 32.

In the system of the back plate electrodes 11, reflectron electrodes 42 and deflecting electrodes 45 described thus far, the large number of ions having various mass-to-charge ratios ejected from the ion source 31 take different periods of time (times of flight) depending on their respective mass-to-charge ratios to complete their flight in the reciprocating path 47 defined within the flight space surrounded by the back plate electrodes 41 and the reflectron electrodes 42. Consequently, the ions are separated from each other according to their mass-to-charge ratio and ultimately detected by the ion detector 32.

Figure 12:
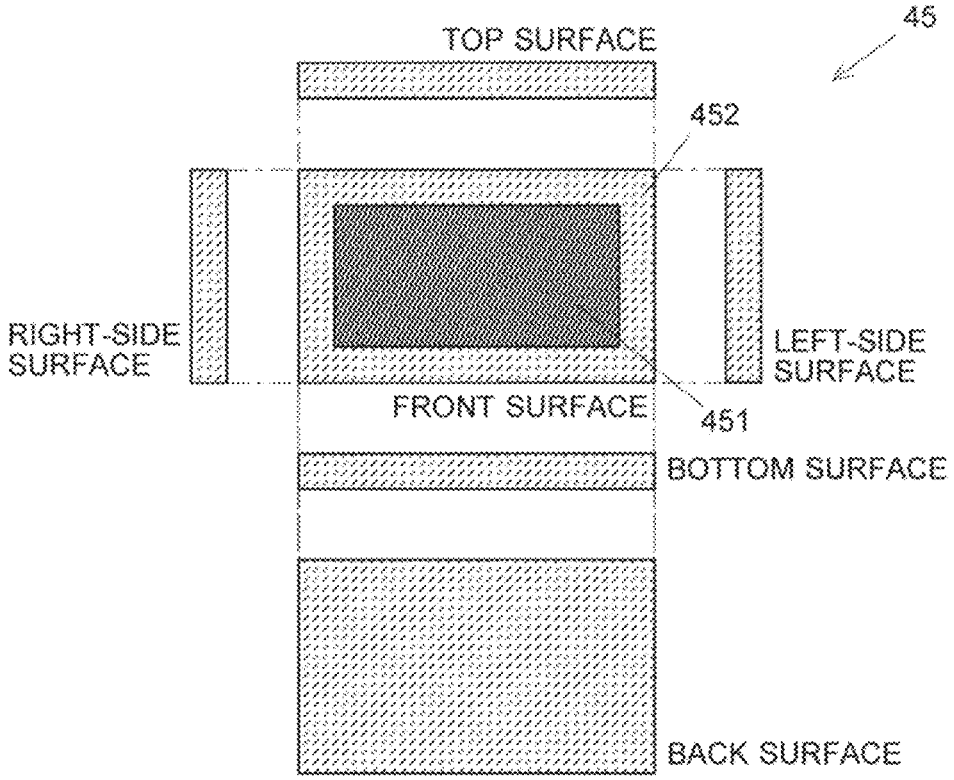
FIG. 12 is a diagram illustrating the portion of the deflecting electrode to which a deflecting voltage is to be applied and the portion to which a reciprocating voltage is to be applied in the MR-TOF-MS according to the present embodiment.

The MT-TOF-MS 3 according to the present embodiment is also characterized by the configuration of the deflecting electrodes 45. As shown in FIG. 12, each deflecting electrode 45 is configured to allow two different voltages to be respectively applied to a first area 451 (a first portion) which is a central portion of the front surface facing the reciprocating path 471 and a second area 452 (a second portion) which includes the remaining portions (including the periphery of the front surface, the side surface, and the back surface). An electrode configured in this manner can be created, for example, by using a printed circuit board (PCB).

The voltage applied to the first area 451 is a voltage for reversing the drifting direction of the ions in the reciprocating path 47 (i.e., the deflecting voltage). Specifically, a predetermined voltage having an opposite polarity to the ions is applied to the first area 451 of one of the deflecting electrodes 45 located closer to the (m−1)th reciprocating path 47, while a predetermined voltage having the same polarity as the ions is applied to the first area 451 of the other deflecting electrode 45. The ions flying in the m-th reciprocating path 471 are thereby deflected toward the (m−1)th reciprocating path 47, and their drifting direction is reversed. The voltage applied to the second area 452 is a voltage for creating an electric field identical to the reciprocating electric field (in the present embodiment, this area is grounded).

In the present embodiment, the deflecting electrodes 45 are arranged so as to face each other within the space between the two reflectron electrodes 42, i.e., across a section of the reciprocating path 47 in which ions are made to fly linearly. Arranging the deflecting electrodes 45 within this type of section where there is no potential gradient and ions are made to fly linearly simplifies the structure of the deflecting electrodes 45 since only a single voltage needs to be applied to the portions other than the first area 451.

In the case of a conventional MR-TOF-MS configured to reverse the drifting direction, the deflecting voltages are applied to the entire area of the deflecting electrodes. Accordingly, similar to the case of the conventional MT-TOF-MS, the fringe electric field created by the application of the deflecting voltages deflects not only the ions flying in the m-th reciprocating path 471 but also those flying in the neighboring (m−1)th reciprocating path 47. Therefore, it is impossible to make the ions fly in the predetermined reciprocating path.

By comparison, in the case of the MR-TOF-MS according to the present embodiment, the deflecting voltage is only applied to the first area 451 at the central portion of the front surface of the deflecting electrodes 45; the reciprocating voltage is applied to the second area 452 including the other portions. Therefore, the deflecting electric field is only created at the m-th reciprocating path 471. Thus, the ions flying in the (m−1)th reciprocating path 47 neighboring the m-th reciprocating path is prevented from undergoing unwanted deflection.

(4) Modified Example of MR-TOF-MS

The previous embodiment is a configuration example and can be appropriately changed or modified. The deflecting electrodes 45 in the previous embodiment are located at a position on the X-axis in the end area of the flight space on the positive side of the X-direction. It is possible to place the deflecting electrodes 45 at a different location.

Figure 13:
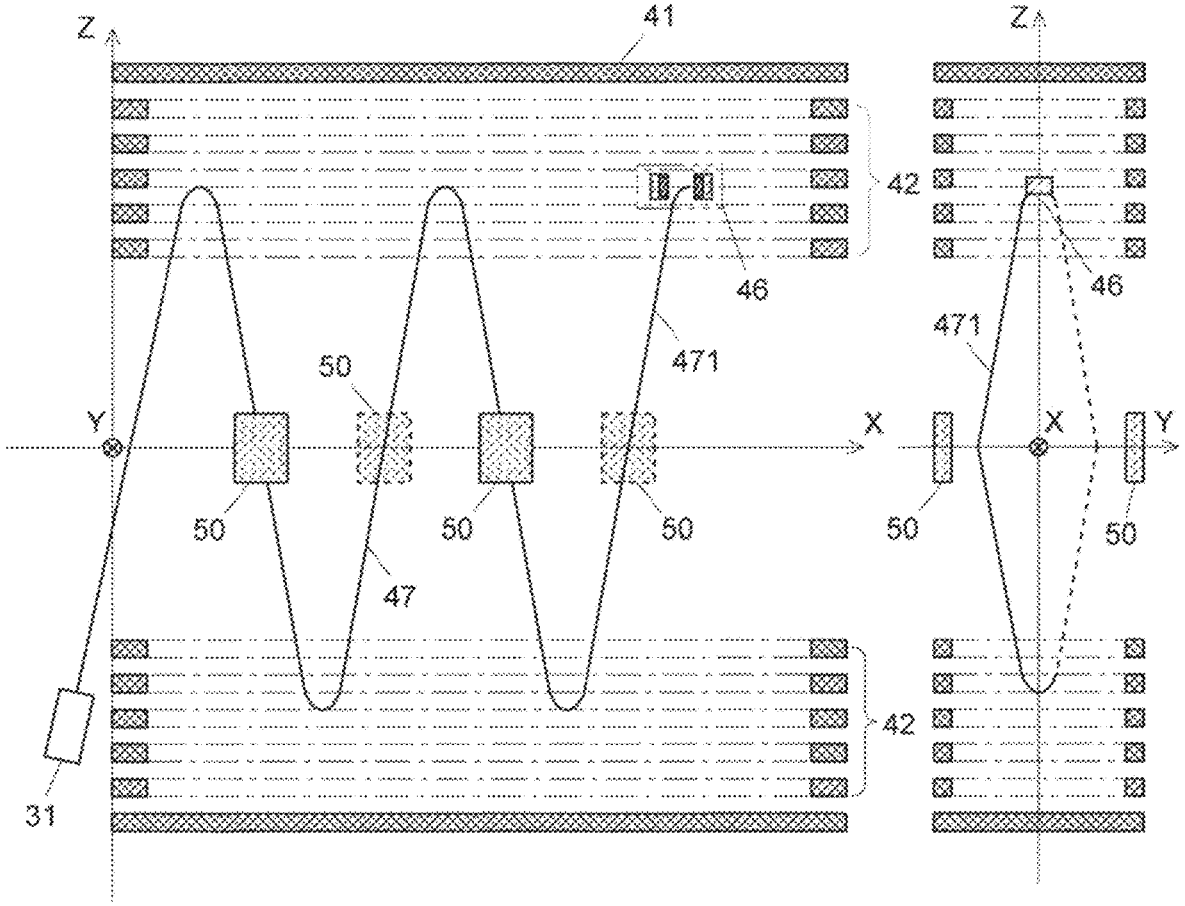
FIG. 13 is a diagram illustrating the location of the deflecting electrodes in the MR-TOF-MS according to a modified example.
Figure 14:
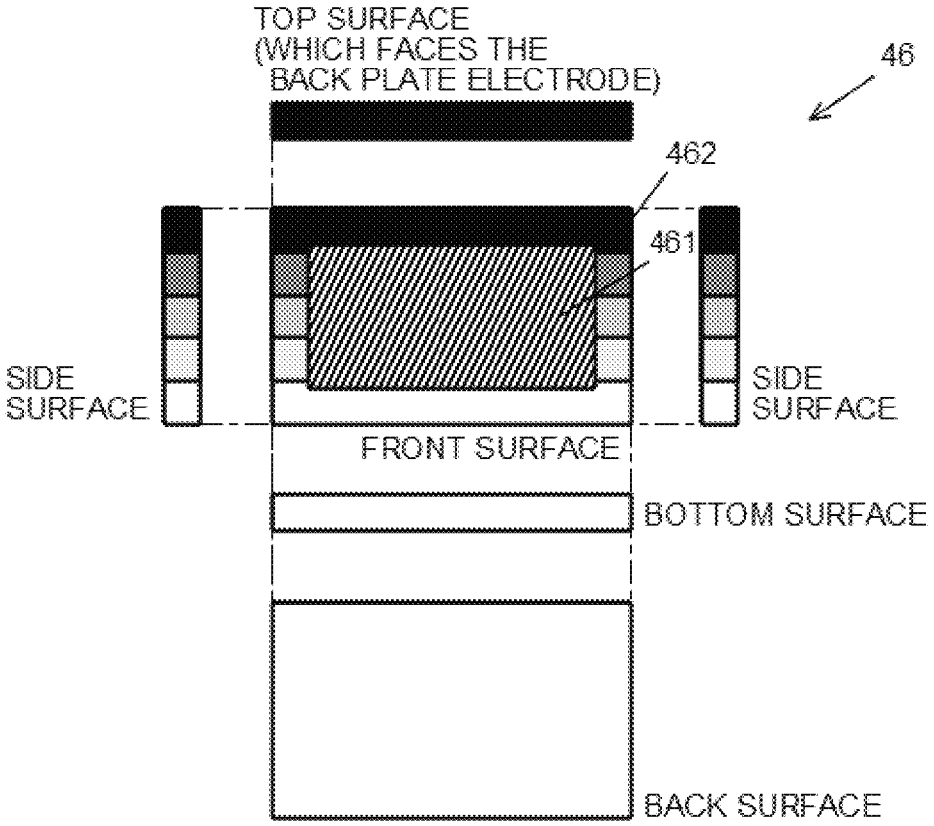
FIG. 14 is a diagram illustrating the portion of the deflecting electrode to which a deflecting voltage is to be applied and the portion to which a reciprocating voltage is to be applied in the MR-TOF-MS according to the modified example.

For example, as shown in FIG. 13, deflecting electrodes 46 may be placed within the space surrounded by the back plate electrode 41 and the reflectron electrodes 42. It should be noted that a reciprocating electric field whose potential increases toward the back plate electrode 41 is created within this space. FIG. 14 shows the voltage to be applied to the deflecting electrode 46 located closer to the back plate electrode 41. As shown in this figure, the deflecting voltage should be applied to the first area 461 of the deflecting electrode 46, as in the previous embodiment, while a voltage that creates an electric field directed parallel to the Z-axis similar to the reciprocating electric field should be applied to the second area 462. In this configuration, different voltages may be respectively applied to a plurality of electrodes provided in the second area 462.

In this modified example, if a reciprocating path that shows no displacement in the Y-direction as in the MR-TOF-MS according to the previous embodiment is used, the ions before the reversal of their drifting direction by the deflecting electric field and the ions whose drifting direction has been reversed by the deflecting electric field fly opposite to each other in the same reciprocating path, so that the two groups of ions may possibly collide with each other. Therefore, in the case of using the deflecting electrodes 46, it is preferable to define the reciprocating path as follows: The direction in which ions are introduced from the ion source 31 into the flight space is additionally inclined in the Y-direction. Reflector electrodes 50 are arranged on the Y-axis as shown in the right section of FIG. 13. A voltage having the same polarity as the ions is applied to the reflector electrodes 50 so that the ions are alternately displaced toward the positive and negative sides of the Y-direction, making a circular turn in the YZ-plane for each reciprocation.

(5) Other Modified Examples

The present invention is not limited to the embodiments and modified examples described so far but can be changed or modified in various forms.

The deflecting electrodes used as the deflecting electrodes 24, 26, 45, 46 in any of the embodiments of the MT-TOF-MS or MR-TOF-MS are formed by a pair of plate electrodes. Other configurations may also be adopted.

Figure 15:
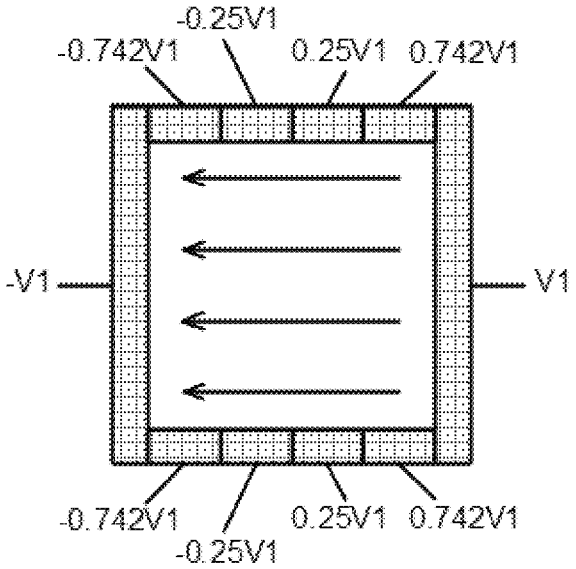
FIG. 15 is an example of the deflecting electrodes usable in a time-of-flight mass spectrometer according to the present invention.

For example, the electrode shown in FIG. 15 includes a pair of plate electrodes arranged in one of the two directions orthogonal to the n-th loop orbit or m-th reciprocating path. Voltages V1 and −V1 are respectively applied to the two plate electrodes to create an electric field. Furthermore, a pair of segmented plate electrodes are arranged in the other direction, and each segment of the electrode is supplied with a voltage corresponding to the potential at the position of the segment. It should be noted that FIG. 15 and subsequent figures are intended to show the configuration of the parts corresponding to the first area of the deflecting electrode, and therefore, illustrate only those parts. An appropriate electrode for applying the loop-flight voltage or reciprocating voltage needs to be additionally provided on the outside of the parts forming the first area.

Figure 16:
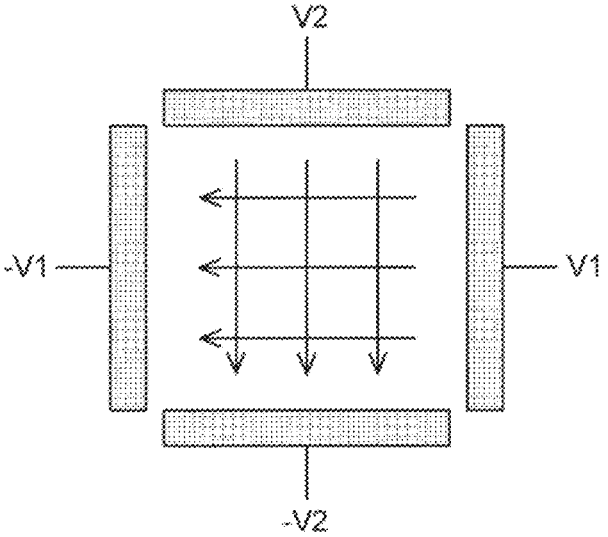
FIG. 16 is another example of the deflecting electrodes usable in a time-of-flight mass spectrometer according to the present invention.

The electrode shown in FIG. 16 includes a pair of plate electrodes arranged in each of the two directions orthogonal to the n-th loop orbit or m-th reciprocating path. Voltages V1 and −V1 are respectively applied to one pair of the plate electrodes, while voltages V2 and −V2 are respectively applied to the other pair of the plate electrodes. The electrode shown in FIG. 16 can deflect ions by a deflecting electric field having equal or different magnitudes of potential difference in two directions.

Figure 17:
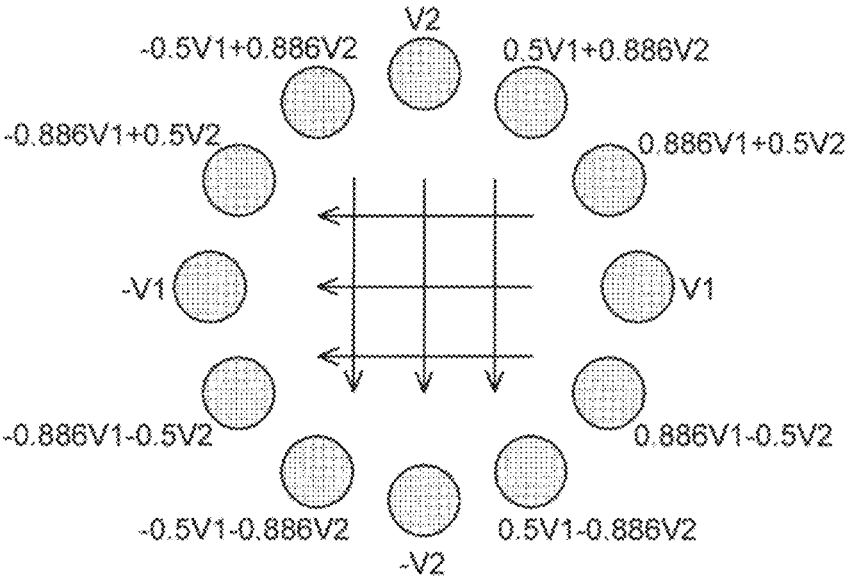
FIG. 17 is still another example of the deflecting electrodes usable in a time-of-flight mass spectrometer according to the present invention.

The electrode shown in FIG. 17 includes 12 rod electrodes arranged so as to surround the n-th loop orbit or m-th reciprocating path. Each rod electrode is supplied with a different voltage. Similar to the electrode shown in FIG. 16, this electrode can also deflect ions by a deflecting electric field having equal or different magnitudes of potential difference in two directions.

The MT-TOF-MS according to the previous embodiment is an example in which an elliptical loop orbit is used. A similar configuration to the previous embodiment can also be adopted in MT-TOF-MSs having various forms of loop orbits, such as a circular shape or figure-"8" shape.

In the MT-TOF-MSs according to the previous embodiment and modified example, the ion inlet and the ion outlet are provided in the outer electrode so that ions are linearly introduced into the loop orbit or linearly released from the loop orbit. It is also possible to provide the ion inlet and the ion outlet in the inner electrode along with additional deflecting electrodes appropriately arranged.

MODES OF INVENTION

A person skilled in the art can understand that the previously described illustrative embodiments are specific examples of the following modes of the present invention.

(Clause 1)

A time-of-flight mass spectrometer according to one mode of the present invention includes:

a loop-orbit defining electrode configured to create a loop-flight electric field for defining a loop orbit in which ions are made to repeatedly turn while gradually drifting in a predetermined direction for each turn, the loop-orbit defining electrode including an outer electrode located on the outside of the loop orbit and an inner electrode located on the inside of the loop orbit;

an ion inlet for introducing ions into the loop orbit;

an ion outlet for releasing ions from the loop orbit;

a loop-flight voltage applier configured to apply loop-flight voltages to the outer electrode and the inner electrode, respectively, so as to create the loop-flight electric field;

a set of deflecting electrodes facing each other across a section of an n-th loop orbit, where n is a predetermined number, the deflecting electrodes including a first portion which faces the n-th loop orbit and a second portion which includes other portions; and a voltage applier configured to apply a deflecting voltage to the first portion so as to reverse the drifting direction of the ions flying in the n-th loop orbit, and a voltage to the second portion so as to create the loop-flight electric field.

The time-of-flight mass spectrometer described in Clause 1 is a multi-turn time-of-flight mass spectrometer (MT-TOF-MS) with an open orbit (quasi-closed orbit). In this mass spectrometer, a loop-flight electric field for defining a loop orbit in which ions are made to fly is created by applying predetermined loop-flight voltages to the outer and inner electrodes forming the loop-orbit defining electrode. Ions are introduced into this loop orbit through the ion inlet and fly in the loop orbit while drifting in the predetermined direction for each turn. At the n-th loop orbit (where n is a predetermined number), a set of deflecting electrodes are arranged so as to face each other across the loop orbit. The deflecting electrodes include a first portion which faces the n-th loop orbit and a second portion which includes other portions. Deflecting voltages are applied to the first portion to reverse the drifting direction of the ions flying in the n-th loop orbit. In this operation, the deflecting voltages are applied to only the first portion facing the n-th loop orbit; a voltage for creating the loop-flight electric field is applied to the second portions. In the case of a conventional MT-TOF-MS, the deflecting voltages are applied to the entire area of the deflecting electrodes, so that the deflecting electric field is created over a wide area around the deflecting electrodes, causing deflection of the ions flying in the loop orbit neighboring the n-th loop orbit. By comparison, in the MT-TOF-MS described in Clause 1, the loop-flight electric field is created at the second portion other than the portion which faces the n-th loop orbit. Thus, the loop-flight electric field defining the loop orbit neighboring the n-th loop orbit is prevented from being disturbed and causing unwanted deflection of the ions.

(Clause 2)

In the time-of-flight mass spectrometer described in Clause 1, the deflecting electrodes may be arranged so as to face each other across a section of the loop orbit in which ions are made to fly linearly.

In the time-of-flight mass spectrometer described in Clause 2, the deflecting electrodes are located at a section in which ions are made to fly linearly, i.e., within an area where there is no potential gradient in the flight space of the ions. This simplifies the structure of the deflecting electrodes since only a single voltage needs to be applied to the second portion other than the portion facing the n-th loop orbit.

(Clause 3)

The time-of-flight mass spectrometer described in Clause 1 or 2 may be configured as follows:

the deflecting electrodes are a pair of plate electrodes; and the first portion forms a central area of a front surface facing the loop orbit and applies a voltage for creating the loop-flight electric field to an area surrounding the central area.

In the time-of-flight mass spectrometer described in Clause 3, the area to which the deflecting voltages are applied is limited to the central area of the front surface facing the loop orbit. Therefore, unwanted deflection of the ions flying in a loop orbit other than the n-th loop orbit will be more assuredly suppressed.

(Clause 4)

A time-of-flight mass spectrometer according to another mode of the present invention includes:

a reciprocating-path defining electrode configured to create a reciprocating electric field for defining a reciprocating path in which ions are made to repeat a reciprocating motion while drifting in a predetermined direction for each reciprocating, the reciprocating-path defining electrode including a set of reflectron electrodes located on both sides of a flight space of the ions;

an ion inlet for introducing ions into the reciprocating path;

an outlet inlet for releasing ions from the reciprocating path;

a reciprocating voltage applier configured to apply reciprocating voltages to the set of reflectron electrodes, respectively, so as to create the reciprocating electric field;

a set of deflecting electrodes facing each other across a section of an m-th reciprocating path, where m is a predetermined number, the deflecting electrodes including a first portion which faces the m-th reciprocating path and a second portion which includes other portions; and a voltage applier configured to apply a deflecting voltage to the first portion so as to reverse the drifting the drifting direction of the ions flying in the m-th reciprocating path and a voltage to the second portion so as to create the reciprocating electric field.

The time-of-flight mass spectrometer described in Clause 4 is a multi-reflection time-of-flight mass spectrometer (MR-TOF-MS). In this mass spectrometer, a reciprocating electric field for defining a reciprocating path in which ions are made to fly is created by applying predetermined reciprocating voltages to a set of reflectron electrodes located on both sides of the flight space of the ions. Ions are introduced into the reciprocating path through the ion inlet and fly in the reciprocating path while drifting in the predetermined direction for each reciprocating. At the m-th reciprocating path (where m is a predetermined number), a set of deflecting electrodes are arranged so as to face each other across the reciprocating path. The deflecting electrodes include a first portion which faces the m-th reciprocating path and a second portion which includes other portions. Deflecting voltages are applied to the first portion to reverse the drifting direction of the ions flying in the m-th reciprocating path. In this operation, the deflecting voltages are applied to only the first portion facing the m-th reciprocating path; a voltage for creating the reciprocating electric field is applied to the second portion. In the MR-TOF-MS described in Clause 4, since the reciprocating electric field is created at the second portion other than the portion which faces the m-th reciprocating path, the reciprocating electric field defining the reciprocating path neighboring the m-th reciprocating path is prevented from being disturbed and causing deflection of the ions.

(Clause 5)

In the time-of-flight mass spectrometer described in Clause 4, the deflecting electrodes may be arranged so as to face each other across a section of the reciprocating path in which ions are made to fly linearly.

In the time-of-flight mass spectrometer described in Clause 5, the deflecting electrodes are located at a section in which ions are made to fly linearly, i.e., within an area where there is no potential gradient in the flight space of the ions. This simplifies the structure of the deflecting electrodes since only a single voltage needs to be applied to the second portion other than the portion facing the m-th reciprocating path.

(Clause 6)

The time-of-flight mass spectrometer described in Clause 4 or 5 may be configured as follows:

the deflecting electrodes are a pair of plate electrodes; and the first portion forms a central area of a front surface facing the reciprocating path and applies a voltage for the reciprocating electric field to an area surrounding the central area.

In the time-of-flight mass spectrometer described in Clause 6, the area to which the deflecting voltages are applied is limited to the central area of the front surface facing the reciprocating path. Therefore, unwanted deflection of the ions flying in a reciprocating path other than the m-th reciprocating path will be more assuredly suppressed.

REFERENCE SIGNS LIST

1 . . . Multi-Turn Time-of-Flight Mass Spectrometer (MT-TOF-MS)
11 . . . Ion Source
12 . . . Ion Detector
20 . . . Ion Flight Unit
21 . . . Main Electrode
211 . . . Outer Electrode
212 . . . Inner Electrode
22 . . . Ion Inlet
23, 27 . . . Ion Outlet
24, 26 . . . Deflecting Electrode
241, 261 . . . First Area
242, 262 . . . Second Area
25 . . . Loop Orbit
251 . . . n-th Loop Orbit
28 . . . Loop-Flight Voltage Applier
29 . . . Deflecting Voltage Applier
3 . . . Multi-Reflection Time-of-Flight Mass Spectrometer (MR-TOF-MS)
31 . . . Ion Source
32 . . . Ion Detector
40 . . . Ion Flight Unit
41 . . . Back Plate Electrode
42 . . . Reflectron Electrode
43 . . . Ion Inlet
44 . . . Ion Outlet
45, 46 . . . Deflecting Electrode
451, 461 . . . First Area
452, 462 . . . Second Area
47 . . . Reciprocating Path
471 . . . m-th Reciprocating Path
50 . . . Reflector Electrode
48 . . . Reciprocating Voltage Applier
49 . . . Deflecting Voltage Applier

The invention claimed is:

1. A time-of-flight mass spectrometer, comprising:

a loop-orbit defining electrode configured to create a loop-flight electric field for defining a loop orbit in which ions are made to repeatedly turn while gradually drifting in a predetermined direction for each turn, the loop-orbit defining electrode including an outer electrode located on an outside of the loop orbit and an inner electrode located on an inside of the loop orbit;

an ion inlet for introducing ions into the loop orbit;

an ion outlet for releasing ions from the loop orbit;

a loop-flight voltage applier configured to apply loop-flight voltages to the outer electrode and the inner electrode, respectively, so as to create the loop-flight electric field;

a set of deflecting electrodes facing each other across a section of an n-th loop orbit, where n is a predetermined number, the deflecting electrodes including a first portion which faces the n-th loop orbit and a second portion which includes other portions; and a voltage applier configured to apply a deflecting voltage to the first portion so as to reverse the drifting direction of the ions flying in the n-th loop orbit, and a voltage to the second portion so as to create part of the loop-flight electric field.

2. The time-of-flight mass spectrometer according to claim 1, wherein the deflecting electrodes are arranged so as to face each other across a section of the loop orbit in which ions are made to fly linearly.

3. The time-of-flight mass spectrometer according to claim 1, wherein:

the deflecting electrodes are a pair of plate electrodes; and the first portion forms a central area of a front surface facing the loop orbit and applies a voltage for creating the loop-flight electric field to an area surrounding the central area.

4. A time-of-flight mass spectrometer, comprising:

a reciprocating-path defining electrode configured to create a reciprocating electric field for defining a reciprocating path in which ions are made to repeat a reciprocating motion while drifting in a predetermined direction for each reciprocating trip, the reciprocating-path defining electrode including a set of reflectron electrodes located on both sides of a flight space of the ions;

an ion inlet for introducing ions into the reciprocating path;

an outlet inlet for releasing ions from the reciprocating path;

a reciprocating voltage applier configured to apply reciprocating voltages to the set of reflectron electrodes, respectively, so as to create the reciprocating electric field;

a set of deflecting electrodes facing each other across a section of an m-th reciprocating path, where m is a predetermined number, the deflecting electrodes including a first portion which faces the m-th reciprocating path and a second portion which includes other portions; and a voltage applier configured to apply a deflecting voltage to the first portion so as to reverse the drifting the drifting direction of the ions flying in the m-th reciprocating path and a voltage to the second portion so as to create part of the reciprocating electric field.

5. The time-of-flight mass spectrometer according to claim 4, wherein the deflecting electrodes are arranged so as to face each other across a section of the reciprocating path in which ions are made to fly linearly.

6. The time-of-flight mass spectrometer according to claim 4, wherein the deflecting electrodes are a pair of plate electrodes; and the first portion forms a central area of a front surface facing the reciprocating path and applies a voltage for the reciprocating electric field to an area surrounding the central area.

* * * * *